US006302793B1

(12) United States Patent
Fertitta, III et al.

(10) Patent No.: US 6,302,793 B1
(45) Date of Patent: Oct. 16, 2001

(54) MULTI-PROPERTY PLAYER TRACKING SYSTEM

(75) Inventors: Frank Fertitta, III; Blake Sartini; Marshall Andrew; Thomas Westdorp, all of Las Vegas, NV (US)

(73) Assignee: Station Casinos, Inc., Las Vegas, NV (US)

( * ) Notice: Subject to any disclaimer, the term of this patent is extended or adjusted under 35 U.S.C. 154(b) by 0 days.

(21) Appl. No.: 09/109,147

(22) Filed: Jul. 2, 1998

(51) Int. Cl.[7] ..... A63F 9/24
(52) U.S. Cl. ..... 463/25
(58) Field of Search ..... 463/17, 25, 29, 463/27, 40, 42, 43

(56) References Cited

U.S. PATENT DOCUMENTS

| | | | |
|---|---|---|---|
| 4,072,930 | 2/1978 | Lucero et al. | 340/152 T |
| 4,283,709 | 8/1981 | Lucero et al. | 340/147 R |
| 4,531,187 | 7/1985 | Uhland | 364/412 |
| 4,636,951 | 1/1987 | Harlick | 364/412 |
| 4,755,941 | 7/1988 | Bacchi | 364/412 |
| 4,815,741 | 3/1989 | Small | 273/138 A |
| 4,882,473 | 11/1989 | Bergeron et al. | 235/380 |
| 5,007,641 | 4/1991 | Seidman | 273/138 A |
| 5,038,022 | 8/1991 | Lucero | 235/380 |
| 5,080,364 | 1/1992 | Seidman | 273/138 A |
| 5,083,271 | 1/1992 | Thatcher et al. | 364/411 |
| 5,129,652 | 7/1992 | Wilkinson | 273/139 |
| 5,179,517 | 1/1993 | Sarbin | 364/410 |
| 5,257,179 | 10/1993 | DeMar | 364/410 |
| 5,265,874 | 11/1993 | Dickinson et al. | 273/138 A |
| 5,276,312 | 1/1994 | McCarthy | 235/380 |
| 5,287,269 | 2/1994 | Dorrough | 364/408 |
| 5,321,241 | 6/1994 | Craine | 235/380 |
| 5,429,361 | 7/1995 | Raven et al. | 273/138 A |
| 5,457,306 | 10/1995 | Lucero | 235/380 |
| 5,470,079 | 11/1995 | LeStrange | 273/138 A |
| 5,559,312 | 9/1996 | Lucero | 235/380 |
| 5,586,936 | 12/1996 | Bennett et al. | 463/25 |
| 5,613,912 | 3/1997 | Slater | 463/25 |
| 5,655,961 | 8/1997 | Acres et al. | 463/27 |
| 5,678,679 | 10/1997 | Berman | 194/344 |
| 5,761,647 * | 6/1998 | Boushy | 705/10 |

OTHER PUBLICATIONS

PRC Gaming Systems, "Pit Track Tracking System".
Autotote, "Probe XL".

* cited by examiner

*Primary Examiner*—Jessica J. Harrison
*Assistant Examiner*—Kim T. Nguyen
(74) *Attorney, Agent, or Firm*—Townsend and Townsend and Crew

(57) ABSTRACT

A player tracking system and method are set forth for tracking the play of a customer playing wagering games at any one of a plurality of gaming venues. The system and method includes a local database for each venue and a central database. In response to reading a player tracking card the player's file at the local database is placed into an open condition to receive updated gaming information. When the player terminates their gaming session, gaming activity data is sent to the player's file at the local database and as network data to the central database as well as other venue local databases to maintain a current record of gaming information throughout the system for the purposes of tracking wagering activity and providing promotions to the player based, at least in part, on that wagering activity.

9 Claims, 2 Drawing Sheets

MULTI-PROPERTY PLAYER TRACKING SYSTEM

FIELD OF THE INVENTION

The present invention is directed to systems and methods for tracking the play of players at casinos and other gaming establishments.

BACKGROUND

In casinos it has been known to link electronic gaming machines, commonly and generically referred to as slot machines, to not only monitor the performance and operation of the machine but also to link the machines to a database to track the wagering history of players. Using this wagering history, the player can be rated. By rating what is meant is that the player's gaming activity, i.e. average wager, time spent wagering, overall amount wagered during a gaming session, is assessed to determine the level and nature of promotions available to the player to stimulate play and develop a relationship between the casino and the player and for marketing the casino to the players based, in part, on ratings. For example, players whose wagering history indicates that they play frequently at larger denomination, e.g. dollar, machines, will warrant special promotions, referred to in the industry as "comps", in order to foster goodwill as well as a degree of customer loyalty with the establishment.

These tracking systems typically operate by the casino issuing to the player to be tracked a player card which includes a machine readable, magnetic strip encoded with data identifying the player. A database is provided at the casino to include the player's name, address and card code and a read/write player file is established. When the player wishes to play a slot machine, they insert their card into a card reader at the machine. The reader interfaces with the a processor which, in turn, interfaces with the database to locate the player's file and place it in an open condition. Each time the player makes a wager at the gaming machine, "comp points" relating to the amount of the wager are accumulated. When the player removes their card from the reader, the slot machine processor or a local file server transfers and rewrites the accumulated points into the player's file. The player's account is updated or summed with the current amount of accumulated points and placed into a closed condition. Thus these player tracking systems track the level of play, i.e. amount wagered during the gaming session, and award comp points in relation thereto. Based upon the accumulated comp points the player receives promotions such as meals, discounts, etc. which promote goodwill and customer loyalty.

Player tracking systems according to the prior art are discussed and described in Acres et al U.S. Pat. No. 5,655,961 hereby incorporated by reference.

A drawback of these prior player tracking systems is that they are property specific. That is, if the player is issued a player card and has an account opened at one casino property, they cannot use that card at another casino property. The player must, therefore, enlist to have their play tracked at each property he/she wishes to game. Heretofore there has been no adequate system or method to track the play of a player at multiple properties, regardless of whether the properties are geographically remote or next door. There is a need for such a system, particularly in venues where several casino properties are commonly owned and geographically near. Any such system should accommodate the possibility that a player may game at a plurality of properties on the same day or even within a few minutes or hours and thus require substantially real time updating of their tracking file.

Heretofore unrelated to player tracking is the concept of progressive jackpots. Presently, it is known to provide several slot machines networked to a processor which accumulates a jackpot from a portion of each amount wagered at each machine. As people wager at the machines, the progressive jackpot grows until a player obtains a designated jackpot outcome whereupon the progressive jackpot amount is awarded to that player. Depending upon the number of machines and the amount wagered at the machines large progressive jackpots of several millions can be assembled. These progressive jackpots encourage play of the machines by the players.

A drawback with progressive jackpots is that players may feel that they are simply contributing to a jackpot which will be won by another. This is particularly true of tourist or other gamblers who may infrequently visit gaming venues and hence may believe that players who are able to visit the casino on a more frequent basis are more likely to win the progressive jackpot than they. There is a need for a system which can assemble a personal, progressive, player bonus which can only be won by the player who has contributed to their own bonus jackpot. Such a system would avoid the drawbacks of existing progressive jackpot systems and still provide the benefit of encouraging play. Such a system would be particularly well suited when married to a system which can track play at any one of a variety of gaming venues whereby the player, from any one of those venues, can contribute to their personal, progressive, player bonus.

SUMMARY OF THE INVENTION

There is therefore provided according to the present invention a system and method which provides for virtually real time player tracking of a player who may be gaming at any one of a plurality of gaming venues and which provides for the player, based upon their play, to contribute to their own personal, progressive, player bonus to be won when that player obtains a designated jackpot outcome.

Toward this end a system for tracking the play of players playing a casino game at any one of a plurality of remote locations is set forth which includes a player card issued to each player. The location where the player enlists to be tracked by the system defines a player home location. Each card includes a machine readable element including card data corresponding to an account number assigned to the player when the player enlists. This player card may be of the type presently used in player tracking systems wherein the readable element is a magnetic strip encoded with data. A local database is provided for each gaming location, the database for the designated home location including a home player data structure including, for each player issued a card upon enlistment, a player account file including home location data of at least: (a) a player account number, (b) player identification data such as name and address, (c) player account data relating to the player's wagering activity and (d) player personal and credit information data. The player account data relating to wagering activity will include wagering data related to the player and may be in the form of comp points which correlate to the cumulative amounts wagered by the player while gaming. The local databases for non-home locations in the system where the player has played before and therefore has been identified to the local data structure include player account network file data. The network file will contain less data than is contained in the home location data structure account file for that player such as by not including player personal or credit information, but will contain data which non-home location casinos need to access to service the player including at least data corresponding to player account number and wagering activity data.

To accumulate wagering activity data, means are provided and are associated with each game for reading the machine readable element of a card and creating card data signals corresponding to the card data when said card is present. These reading means may be a card reader disposed at the slot machine, live table game (e.g. Blackjack, Keno, Craps) or sports wagering facility. The readers and the internal processors for slot machines are linked to a local file server which provides for file access and management for that location's local database. The servers also, through a suitable data transmission link, provide for file access and management of a central player database. The central database, through the local servers, is in communication with all the established local databases, including the home location database.

When a player presents their card to the reader at the machine or game, the local server, through the network, accesses the local database for the location where the player is gaming to find the player's file and, if found, places that file in an open condition. If the player's file is not found at the local database, the server accesses, over the link, the central player database to locate that player's network file. If the local player database does not include a player file but the central database does, the player's network data from the central database is retrieved and copied to the local database as a newly created local account file for that player and the file is placed into an open condition. The local server is also adapted to close the player's file when the card is no longer being read, i.e. when the player removes it from the card reader. Where the game is a live table game of sports wagering, the account is closed when a signal is sent from the reader to close the file.

During play and for slot machines, the local server accumulates wagering data which corresponds to the amounts wagered by the player. The local server also sends machine identification and performance data to the local database to identify the machine and monitor its performance, i.e. wagering, payouts, malfunctions. When the player removes their card from the reader, wagering activity data of the player accumulated at the local server is updated to reflect the new gaming activity, and the updated data is sent to the player's local database account file and the player's file at the local database is placed into the closed condition.

For live table games or sports wagering, the amounts wagered or the average wager per unit time, e.g. per hour, is entered and when the gaming session is ended the wager data is sent to the file and a signal is entered at the reader to place the file in a closed condition.

Means responsive to closure of the player's file send the updated gaming data over the network link to the central database to update the data based upon the recent gaming activity. Further, over the network any other local player database having a local file for the player, i.e. a locality where the player has played before and thus had their network file data copied to that locale's local database, is also updated to reflect the new gaming activity of the player. Thus upon closure of the player's file at the location where the player is gaming, wagering activity network data is updated at all local databases (which include a player account file) as well as the central database.

Accordingly, when the player removes their card (or their account is otherwise closed), their account file at all locations is updated to reflect new wagering data. From any location, the local account file for the player can be accessed to determine their rating or level of play which is maintained current. Further, for promotional purposes all locations include a data file for each networked player and based thereon can offer comps, send mailings and craft marketing strategies.

As a further feature, the player's files are only maintained at the central database, the home location and any location within the network where that player has played. Locations not frequented by the player are not required to store player account data for the player nor is the network required to transmit and update data to these locations.

As a further feature, each player account file may include personal, progressive, player bonus data. Each time the player games, a portion of their wagers is assigned to and summed as the player bonus and retained as network data. Hence each location would have current, updated data as the amount of the personal, progressive, player bonus. Should the player at any network location obtain a qualifying jackpot outcome, they would be awarded, in addition to any other amounts for obtaining the outcome, the then current amount of their player bonus. This feature enables the player to contribute to a personal bonus which only they can win.

The personal, progressive, player bonus feature can be individual or can also be provided to multiple individuals such as husband and wife or family members by using the same account number or by linking the accounts for each member of the group.

Also set forth is a method for tracking the play of a player playing a casino game at any one of a plurality of geographically remote locations where each player establishes a player account at one of the locations defining a home location and is issued a player identification card having a machine readable element including data identifying the player's account. The method includes:

(i) providing a local database at each location and a central database;

(ii) linking each local database to the central database to define a network for the transmission of data therebetween;

(iii) inputting player home account data (HAD) into a local database at the location where the player enlists to have their wagering activity tracked, the HAD including account identification data, player identification data, data corresponding to the player's wagering activity and player personal and credit data;

(iv) transmitting through said network link as network account data (NAD) at least said account identification data and wagering activity data;

(v) reading the player's identification instrument at the casino game to be played by the player at one of the locations, the player's local account file at that location being placed in an open condition in response to reading said element on the instrument and closing the account file in response to no longer reading said element;

(vi) sending data relating to the player's wagering activity at the game to said player's account file at the gaming location; and (vii) in response to closure of the player's account, processing the wagering data to update the player's account wagering activity data at the gaming location local database, and providing the updated wagering activity data over the network to the central and other local databases to correspondingly update the player's NAD and HAD.

Thus it can be seen that no matter where the player games at any of the network locations, their account data at least data relating to wagering activity, is updated upon closure of the player's account when they, for example, remove their card from the slot machine card reader.

The method further includes accruing for each player as network account data, a personal, progressive, player bonus. Each time the player wagers, data representing an portion of the amounts are accrued to their account file as player bonus data. When the player obtains a jackpot outcome, in addition to any other prize, they are awarded the accrued amount of their accrued player bonus.

As a further feature of the system and method of the present invention, players may be classified as between a plurality of classes based upon their ratings. Players in the higher rated classification would be entitled to more significant comps and awards than those in lower-rated classes. Periodically, the central database file server would retrieve the player's files and reclassify them based upon their play during the preceding period. This data would be updated as NAD at the central database and all local database(s).

The system and method of the present invention enables players to carry a single player card and to gamble at any one of the networked locations and have that wagering activity credited to their account. Further since their account is updated when they remove their card from the reader or when their account is otherwise closed throughout the network, a player can gamble at one location and walk to another network location in several minutes and gamble there, all the while having their account file updated and current. Further, by providing a personal, progressive, player bonus, the player contributes to a jackpot which only he/she can win. Thus there is no feeling that the player is contributing to a jackpot which will be won by others.

BRIEF DESCRIPTION OF THE DRAWINGS

These and other features and advantages will become better appreciated as the same becomes better understood with reference to the description, claims and drawings wherein:

DESCRIPTION

Figure 1:
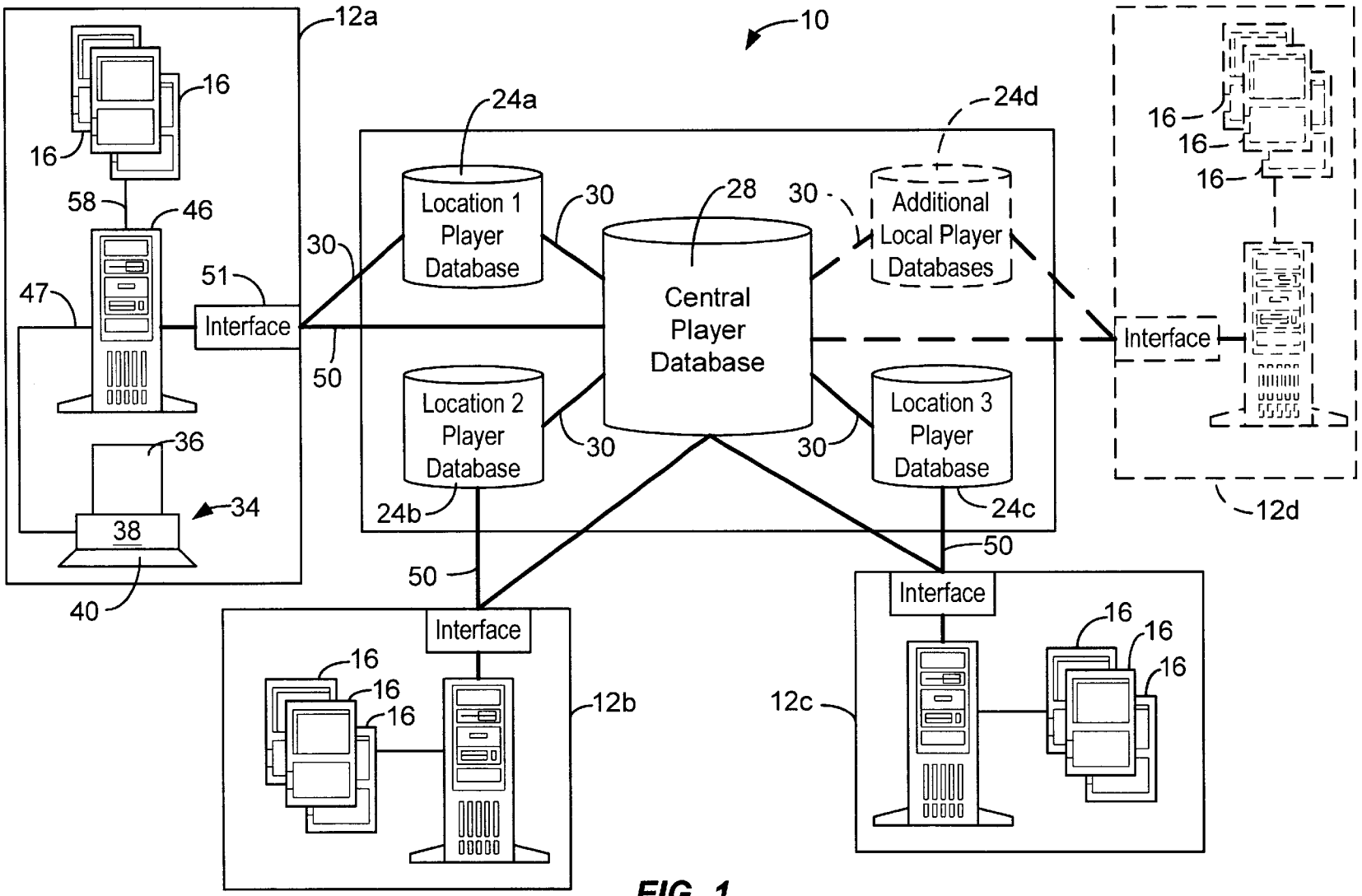
FIG. 1 is a diagram of the system and method of the present invention.

Turning to FIG. 1, a system 10 according to the present invention for tracking the wagering activity of players at any one of several locations, shown as locations 12*a–d*, is provided. Location 12*d* is indicated as a future location to demonstrate that the system 10 can be expanded to include new locations. While only four locations are shown in FIG. 1, it is to be understood that the system 10 and method of the present invention are applicable to more locations. These locations may be adjacent, across town, in different cities, states or even in different countries. Accordingly, while the description set forth below is confined to a situation having only four locations at which players can engage in wagering activity, the system 10 is applicable for tracking the wagering activity of players at many locations.

Figure 2:
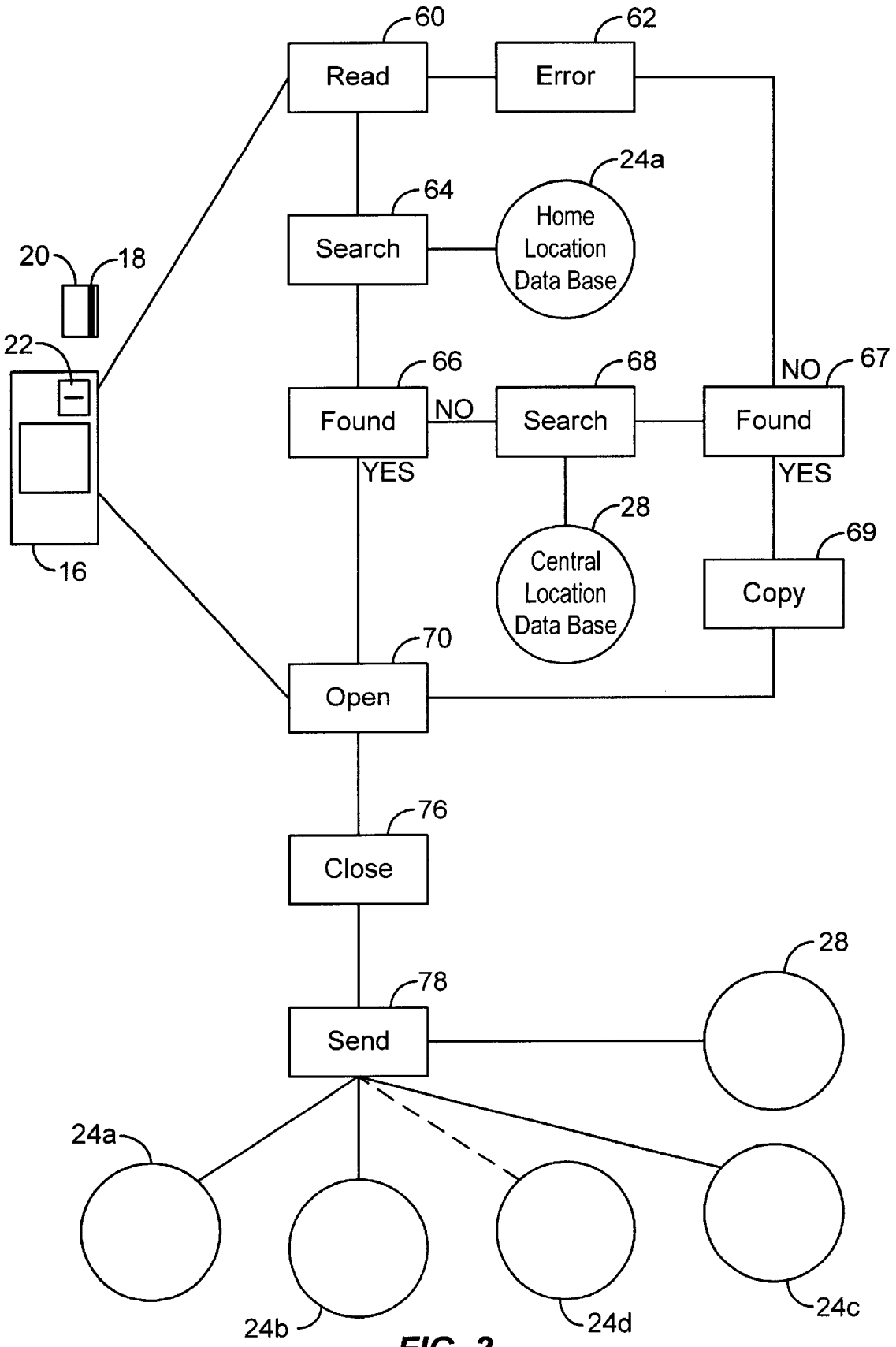
FIG. 2 is a diagram illustrating the processing of data according to the system and method of the present invention.

Each of the locations 12*a–d* provides numerous games by which players, in a known fashion, can make wagers, play a game to produce an outcome, and, based upon that outcome either win or lose their wager. These games may be table games such as Blackjack or Craps or sports wagering at which the casino may wish to track the play of players or may be, as shown in FIGS. 1 and 2, slot machines 16 of a known design. As used herein, slot machines 16 include video poker machines, video Keno machines, video Blackjack machines, the well known reel-type slot machines or any other electronic or electromechanical wagering devices. Accordingly, it is to be understood that the use of the term slot machines generically refers to electronic and electromechanical gaming devices. Further it is to be understood that while the description hereinafter set forth is directed to slot machines, it can be used to track play at table games and for sports wagering as well thereby tracking play regardless of the nature of the wagering activity engaged by the player.

As is well known, modern slot machines 16 are under control of a internal processor (not shown) which not only controls the play of the game but also makes random selections of indicia such as cards, numbers or symbols to produce an outcome. Based upon the outcome obtained, the processor controls whether or not the player loses their wager, whether they win their wager and the amount of the payoff to the player. Also in a known fashion, the slot machines 16 include means to receive a wager as by a player inputting a token or coin or by wagering accumulated credits at the machine. The internal processor of the slot machine senses the input of a wager and the amount thereof for the play of the game. The data signals generated by the internal processor of the slot machine 16 of payouts to players and wagers made as well as other events such as when the machine is opened for servicing, malfunctions and the like are issued by the machine's processor for purposes which will hereinafter become evident.

With reference to FIGS. 1 and 2, each of the slot machines 16 has associated therewith means for reading a machine readable element 18 of a player tracking card 20 issued to the player in a manner described below. Preferably, the machine readable element 18 is a magnetic strip on the player tracking card 20 which is encoded with data unique to the player for identifying the player to the system 10 in the manner described below. The card reading means are shown in FIG. 2 as card readers 22 disposed at each of the slot machines 16. The card readers 22 are adapted to, in response to insertion of the player tracking card 20 therein, issue data signals corresponding to the presence of the card 20 and the data encoded on the machine readable element 18. This data from the card readers 22 is used by the system 10 in a manner described below.

Each of the locations 12*a–d* includes a local data structure, shown in FIG. 1 as a home data structure 24*a* and local data structures 24*b–d*. The home data structure 24*a* is designated for the location at which the player enlists to be tracked by the system 10 and at which he/she is issued their player tracking card 20. The home data structure 24*a* contains home location file data for each player who enlisted at that location. The home data structure 24*a* would therefore contain home player account file data for all players who enlisted to be tracked at the first location 12*a*. Likewise at the other locations 12*b–d*, the local data structures 24*b–d* would contain, for players who enlisted to be tracked at those locations 12*b–d*, home location player account file data for those players. Thus, it is to be understood that if the home location 12*a* is "ABC Casino," players who enlist to be tracked at the ABC Casino would have stored in the home data structure 24*a* for that casino the player home location account file data. Players who enlist to be tracked at a second location 12*b* called, for example, the "XYZ Casino," would have stored in that local data structure home location player account file data as hereinafter described.

The system 10 also includes a central database 28 communicating with each of the home and local structures 24*a–d* through a suitable network, telecommunications link 30. The central database 28 includes for each player network account file data as hereinafter described. The network file data for each player stored in the central database 28 is an abbreviated amount of data in comparison to the data stored for players at their home location, shown in FIG. 1 as the home location database 24*a*.

Turning to FIG. 1, the enlistment of a player to be tracked by the system 10 is illustrated. To enlist to be tracked, the player enters one of the locations embraced by the system 10, defining the home location and shown in FIG. 1 as the home location 12*a*. There the player presents himself/herself at an enlistment station 34 which includes a monitor 36, enlistment processor 38 and data entry means which may include a keyboard 40 and/or a mouse. The enlistment station 34 also includes a card magnetic strip data encoder (not shown) of known construction. At the enlistment station 34, the player provides information to the casino staff to input into the system 10. The data 47 input: at the home location for each player is as shown in Table 1 below. This data is sent to one of a plurality of servers 46 for the local system which opens a player file at the local database 24*a* for the player enlisting and stores the player's information in that file. The server 46 also assembles from the input of the home location data what will hereinafter be referred to as network data 50. When data entry is complete and a player tracking card 20 is encoded and issued to the player, the home location data is sent to the server 46 by an interface 51 through the link 30 where it is stored at the home location database 24*a* at a newly created home location player file. The network data is sent through the interface 51 and link 30 to open a new player, central database 28 and player file and stores therein the network data for that player. Thus, upon enlistment, the home database 24 includes home location data whereas the central database 28 includes network data 50, each identified by an account number for the player. At the enlistment station 34, a player's account number is assigned to the player. Data identifying the home location and player account number is encoded by the card encoder onto the machine readable element 18. The card is then given to the player.

Table 1 below shows the nature of the home location data and network data stored, respectively, at the player's home location database and at the central and other location databases.

TABLE 1

| Home Location Data | Network Data |
|---|---|
| 1. Player Account Number and Home Location Data<br>a. identifies player account number to system<br>b. identifies home location to the system | Yes |
| 2. Player Identification Data<br>a. name, address, date of birth, Social Security number | Yes |
| 3. Player Account Information<br>a. Comp points balance<br>b. Player rating (level of promotions available to the player)<br>c. Player bonus points balance | Yes |
| 4. Customer Activity Information<br>a. hotel revenue from player<br>b. food and beverage purchases<br>c. retail purchases | Yes |

TABLE 1-continued

| Home Location Data | Network Data |
|---|---|
| 5. Player personal and credit data<br>a. Credit worthiness data<br>1. Bank information<br>2. Employer data<br>3. Credit limit available to player<br>4. Credit transaction history with casino<br>5. Casino contact for approving credit<br>6. Credit collection history<br>7. Credit write-offs<br>b. Cash transaction history<br>c. Personal data<br>1. Identification card information, e.g. driver's license number<br>2. Gaming data<br>a. gaming preferences, e.g. slot or table games<br>3. Personal information<br>a. phone number, alternate and prior addresses<br>4. Trip information<br>a. prior visits to casino<br>b. length of stays<br>c. accommodation preferences | No |

Table 1 shows generally the categories of data which may be stored as home and network data. Preferably, the network data is less extensive than the home data so as to save network and, as described below, local database data storage and to reduce the amount of data which must be transmitted over the link 30. The home location data includes player account and identification number data as well as the comp point data, which represents the information being tracked for purposes of rating the player. The home location database 24*a* also includes the player personal and credit data used by the home location to supplement the other data, to describe the creditworthiness of the player, e.g. whether and how much credit should be extended to the player, and historical, personal data as well as historical trip information concerning this player. It is to be understood that other home location data could be included such as family data, player comp preferences and the like thought useful in servicing the customer. Thus at the home location, the home location database 24*a* can be accessed to review and change the home location data. The home location data which is not also network data is not accessible to the non-home locations 12*b–d*.

The network data sent and stored at the central database 28 does not include the player personal or credit information. Hence the network data sent to the central database 28 is a somewhat abbreviated amount of data in comparison to the home location data. It is to be understood that the nature and quantity of the home and network data can be altered by adding more data which the casino believes would be useful.

If the player wishes to have credit extended at another location, that location would establish another home location data file for the player to include creditworthiness and personal data. Thus the player may have more than one home location but would have only one card issued.

In addition to the comprehensive data contained for each player as network data, the databases 24*a–d* also include in the player's file "comp points balance" data which reflects the accumulated value of points for the player for the basis of awarding promotions referred to in the industry as comps and "bonus points balance" data which reflects the accumulated total of bonus points in the player's file to be awarded should the player obtain a designated jackpot, e.g. a royal flush on a video poker machine. This comp and bonus data, as shown in Table 1, is included as network data at the central database 28.

Returning to FIG. 1, the slot machines 16 are linked by a local area network to one of a plurality of slot servers 46, each of which may receive data from a plurality of, for example thirty, slot machines 16. Each of the slot servers 46 at a location 12*a–d*, and there may be a plurality of servers 46 at any location since a casino may have over two thousand slot machines 16, is linked by an interface 51 through the link 30 to the local database 24*a–d* and the central database 28. Wagering data and data from the card readers 22 is sent at 58 from each of the slot machines 16 to their designated slot server 46 to locate the player's file, place it in an open condition and allocate comp and bonus points to the file as hereinafter described.

While the system 10 is described with reference to slot machines 16 it is to be understood that the system 10 also accommodates table play such as play by players at Blackjack tables or craps tables or in sports wagering facilities to track the activity of the player playing these games. In those instances, the player would present their player tracking card 20 to the dealer or other casino staff who would present their card to a local card reader and, in a known fashion, input average wager and time of play data and the like for purposes of tracking the player's play. This data is sent to a local server to be allocated to the player's account.

Turning to FIG. 2, the operation of the system 10 and of the method according to the present invention will now be described with a player who has enlisted to have their play tracked while playing a slot machine 16.

The player presents their tracking card 20 to a card reader 22 at the gaming machine 16. When the tracking card 20 is of the type including the magnetic strip, the player inserts their tracking card 20 into the card reader 22. The card reader 22 reads the card at 60. In the event that the card 20 is unable to be read or in the event that the card does not include certain prefix data to identify and negotiate with the system 10, the system 10 at 62 issues an error signal which may be displayed at the card reader 22 for the player to be informed that there is a problem concerning their tracking card 20. If the card has sufficient prefix data to negotiate with the system 10, the card reader data is sent to the local slot server 46, and the server 46 at 64 searches the local database, shown as home location database 24*a*, to locate the player's account file therein and place it at 69 into an open condition. As shown at 66, if the player's account is not found, the server 46 through the interface 51 and link 30 establishes communication with the central database 28 and searches at 68 the central database 28 network data for the player's account. If the player's account is located at 67 in the central database 28, the network data including the player's network maintained comp point data is, at 69, retrieved, a file is opened at the local database 24*a* for the player, the network data is copied to the local database 24*a* and that file at 70 is placed in an open condition. If a file for the player cannot be located at the central database 28, an error signal at 62 is issued to the player.

As can be appreciated, in locations 12*a–d* where the player has gamed and used their tracking card 20, the local databases 24*a–d* will have an account file for the player. In those locations where the player has not played, the local database(s) 24*a–d* will not have a player account file. Thus storage space at the databases is minimized in that account files for players who have enlisted to be tracked by the system 10 but who do not frequent one or more particular locations are not maintained at those locations. For example, the player may have an account file at only the home location and central databases 24*a*, 28, this player not having gamed at any other location.

When the player's account file has been located that file at 70 is placed into an open condition. The player thereafter inputs their wager by inserting tokens or wagering credits at the slot machine 16. The slot machine 16 internal processor sends data 58 concerning the amount wagered to the slot server 46 which accumulates the wagering data while also noting the machine identification number which in turn co-relates to a denomination, i.e. dollar, 25 cent or $5 dollar gaming machine. The player's location file cached at the server 46 remains in the open condition during the time at which the player's tracking card 20 continues to be read by the card reader 22. When the player removes their card, a signal is sent by the card reader 22 indicating that the tracking card 20 is no longer being read signifying that the player is leaving the slot machine 16. When the card is no longer read, the system 10 at 76 closes the player file and sends at 78 the accumulated wagering data cached at the server 46 to the home database 24*a* (or the local database 24*b–d* where the player is playing) updating the data at the location database 24*a–d* with the player's bonus point and comp point data to reflect the wagering activity during the gaming session.

For table games and sports wagering, the player's card is read at a local reader to locate and open the player's account. Casino staff thereafter inputs wagers or average wagers during the gaming session. When the player leaves, the card is again read and the casino employee enters a signal to close the player's account.

Further, and in response to closure of the player's cached account file at the server 46, and through the interface 51 and over the network link 30, this data is also sent to the central database 28, where the player's network file is located and updated to reflect the new wagering activity, i.e. the comp point and bonus data is updated. Further the servers 46, interfaces 51 and link 30 provide for likewise updating the player's account files which exist at any of the other location local databases 24*a–d*. As described above, for those locations where the player has not gamed, no player account files are established at the local database level. Hence there is no updating activity at these location local databases 24*a–d*. However for those locations where the player has gamed and the network data has been copied to the local database 24*a–d*, any established player account files are likewise updated to reflect the new gaming activity in response to closure of the player file at his/her gaming location, in this example home location 12*a*. After the player's existing local and central databases 24*a–d*, have been updated and revised, they are placed into a closed condition.

Thus, the wagering activity of the player at the slot machine 16 is tabulated and the player's home location data at the home location database 24*a* as well as the network data existing at the central database 28 and any other location database 24*b–d* is updated in response to removal of the player's tracking card 20 from the card reader 22. This updating occurs, subject to the time necessary for data transmission of data though the link 30 and data processing, substantially instantaneously. A player can game at one location within the system 10 and then go next door to another location to game with their account files updated almost instantly to reflect their gaming activity. Comp points and bonus point data is not lost or temporarily stored as the player goes from one location to the next due to delays in transmission of the data which would occur if the data was stored for transmission at a later time.

Further, by only updating the player files at locations where the player has gamed saves storage space at local databases 25*a–d* where the player does not game and data transmission is minimized.

The operation of the system 10 and method of the present invention illustrated in FIG. 2 operates whether the player is gaming at the home location 12*a* or any other location 12*b–d* in the system 10.

Should the player obtain a bonus outcome such as by obtaining a royal flush at the slot machine 16, they would be awarded their then current bonus points in addition to the jackpot award for obtaining the royal flush outcome. During play at any location 12*a–d* within the system 10, the bonus point data is updated and current in that there is no lag time between the accumulation of those points during gaming and the assignment of those points to the player's account files.

Should the player wish to obtain a promotion or a comp such a free meal or show, a location 12*a–d* within the system 10 can access their local database 26 (or if necessary the central database 28) to obtain the current level of the player's comp points in their account file and based thereon provide the player with the desired promotion.

Furthermore, each location 12*a–d* within the system 10 has sufficient data for marketing to all network players. Thus, even non-home location casinos have a database to send out mailings, offer tournaments and the like.

As a further feature of the system and method according to the present invention, the network data 50 may also include a player ranking based upon the amount of their comp points. For example, there could be established certain classes of rankings such as silver, gold and platinum to distinguish between three levels of comp points. Players below a first threshold would be assigned to the silver classification, players between the first and a second threshold assigned a gold classification and those above a second threshold assigned a platinum classification. These classifications can be used for marketing purposes to determine which players should receive mailings, personal contact, offers of promotions and the like. Thus, casino staff can simply refer to the classification to determine what level of comps are available to the player. Periodically, the central database server 32 would update the network data 50 to reclassify players based upon wagering activity occurring during the preceding period of time. For example, the central database server 32 may reclassify players monthly based upon the preceding month's wagering activity of the player.

While we have shown and described certain embodiments of the present invention, it is to be understood that it is subject to many modifications and changes without departing from the spirit and scope of the appended claims.

We claim:

1. A system for tracking the play of players playing a casino game at any one of a plurality of remote locations comprising:

(i) a card issued to each player at one of said locations defining a player home location, each card including a machine readable element including card data corresponding to an account number assigned to the player;

(ii) a local data structure including a local database for each location, the local database including a home location data structure including a player account including home location data including (a) a player account number, (b) player identification data, (c) player account data relating to the player's wagering activity, and (d) player personal and credit data, the local data structure for non-home locations including network data including, for each player, network account network data, said network data including player account number and wagering activity data;

(iii) means associated with each game for reading the machine readable element of a card and creating card data signals corresponding to said card data when said card is present;

(iv) a network data link to transmit said card data signals to the local database corresponding to the player's gaming location to, from said card data, locate the player's local database network account and place it in an open condition when the card is presented at the reading means and to close the account when the card is no longer presented;

(v) means for allocating data corresponding to wagering activity of the player to said player's local network account during the period the player's account is in the open condition;

(vi) a central database, said central database including a player data structure including, for each player issued a card at any location, said player account network data;

(vii) a network data link between said local databases and the central database;

(viii) means responsive to closure of the player's account at the gaming location local database for sending data signals to the central database over the network data link to (a) open the player's network account at the central database, (b) allocate the player's wagering activity data to the player's network account at the central database and at the local databases at the non-home locations to reflect new wagering activity data, whereby the home, local and central databases contain updated wagering data, and (c) close the central and non-home location player accounts;

(ix) wherein said local and central data structures for each player account contain personal, progressive, bonus data representing an amount of a personal bonus to be awarded to the player in the event that he obtains a designated bonus outcome at the game; and (x) means for allocating at least a portion of wagers made by each player as personal bonus data to said player's account to progressively increase the amount reflected as said personal bonus.

2. The system of claim 1 further including means to classify the player's account into one of a plurality of classifications based upon said wagering activity data.

3. The system of claim 2 including means to periodically re-classify each of said player's accounts based upon said wagering activity data during the preceding period.

4. A system for tracking the play of players playing a casino game comprising a card issued to each player, each card including a machine readable element including card data corresponding to a player account number assigned to the player;

a database with a database account for each player including the player account number and data relating to each player's wagers;

means associated with the game for reading the machine readable element of the cards and communicating with the database for associating the inserted card with the player's database account and receiving data from and transmitting data to the database;

means for allocating data reflecting the player's wagers to the player's database account;

means establishing personal, progressive bonus data associated with the player's database account representing an amount of a personal bonus to be awarded to the player in the event the player attains a designated outcome at the game; and means for allocating at least a portion of the player's wagers to the player's bonus data to progressively increase the amount of said personal bonus.

5. A method for awarding a casino player a personal bonus as part of a casino game played by the player which can only be won by said player and which progressively increases with play by said player, the method comprising establishing a player account for each player which identifies the player and includes data reflecting cumulative wagering activity by the player;

while the player plays a game, tracking at least his wagering activity;

storing in the player's account a value that reflects the player's cumulative wagering activity as the player's personal bonus; and giving the player the personal bonus when the player achieves a designated bonus outcome as a result of a casino game being played by the player.

6. A method according to claim 5 wherein the designated bonus outcome constitutes a predetermined outcome of a play of the game in progress.

7. A method according to claim 5 wherein the value comprises a predetermined proportion of the player's cumulative wagering activity.

8. A method according to claim 5 wherein tracking includes tracking the player's wagering activity in a plurality of casino locations.

9. A method according to claim 8 wherein the casino locations are geographically separated casinos.

* * * * *